US008819880B2

(12) United States Patent
Ashrafzadeh et al.

(10) Patent No.: US 8,819,880 B2
(45) Date of Patent: Sep. 2, 2014

(54) EFFICIENT ENERGY USAGE FOR A LAUNDRY APPLIANCE

(75) Inventors: Farhad Ashrafzadeh, Stevensville, MI (US); Brian P. Janke, Saint Joseph, MI (US); Peter E. Zasowski, Yantis, TX (US)

(73) Assignee: Whirlpool Corporation, Benton Harbor, MI (US)

( * ) Notice: Subject to any disclaimer, the term of this patent is extended or adjusted under 35 U.S.C. 154(b) by 64 days.

(21) Appl. No.: 13/469,125

(22) Filed: May 11, 2012

(65) Prior Publication Data

US 2013/0160219 A1 Jun. 27, 2013

Related U.S. Application Data

(60) Provisional application No. 61/578,503, filed on Dec. 21, 2011.

(51) Int. Cl.
*D06F 35/00* (2006.01)

(52) U.S. Cl.
USPC ..... 8/158; 68/12.14

(58) Field of Classification Search
USPC ..... 8/158, 159; 68/12.01, 12.02, 12.14
See application file for complete search history.

(56) References Cited

U.S. PATENT DOCUMENTS

| | | | | |
|---|---|---|---|---|
| 5,444,996 | A | 8/1995 | Joslin et al. | |
| 7,383,644 | B2 | 6/2008 | Lyu et al. | |
| 7,574,269 | B2 | 8/2009 | Cenedese et al. | |
| 7,735,239 | B2 | 6/2010 | Jeong et al. | |
| 8,051,685 | B2 | 11/2011 | Kim | |
| 2010/0000022 | A1 | 1/2010 | Hendrickson et al. | |
| 2010/0000024 | A1 | 1/2010 | Hendrickson et al. | |
| 2010/0000264 | A1 | 1/2010 | Luckman et al. | |
| 2010/0000573 | A1 | 1/2010 | Hendrickson et al. | |
| 2010/0000581 | A1 | 1/2010 | Doyle et al. | |
| 2010/0000586 | A1 | 1/2010 | Hendrickson | |
| 2011/0061176 | A1 * | 3/2011 | Kappler et al. | 8/137 |
| 2011/0061177 | A1 | 3/2011 | Kappler | |

FOREIGN PATENT DOCUMENTS

| | | | |
|---|---|---|---|
| DE | 19802650 | A1 | 7/1999 |
| EP | 1354997 | A1 | 10/2003 |
| EP | 2481842 | A1 | 8/2012 |
| FR | 2635539 | A1 | 2/1990 |
| JP | 7323195 | A | 12/1995 |
| WO | 2010003952 | A1 | 1/2010 |

OTHER PUBLICATIONS

European Search Report for Corresponding EP 12197072.7, Apr. 26, 2013.

* cited by examiner

*Primary Examiner* — David Cormier

(57) ABSTRACT

A laundry treating appliance has a rotatable drum at least partially defining a treating chamber for receiving a laundry load for treatment according to at least one cycle of operation and operated such that the extraction of liquid from the laundry load is controlled based on the inertia of the laundry load so that the total energy usage by the laundry treating appliance and a laundry drying appliance with which it is operably coupled may be minimized.

13 Claims, 5 Drawing Sheets

EFFICIENT ENERGY USAGE FOR A LAUNDRY APPLIANCE

CROSS REFERENCE TO RELATED APPLICATIONS

The present application claims the benefit of U.S. Provisional Patent Application No. 61/578,503, filed Dec. 21, 2011, which is incorporated herein by reference in its entirety.

BACKGROUND OF THE INVENTION

Laundry treating appliances, such as a washing machine, may include a drum defining a treating chamber for receiving and treating a laundry load according to a cycle of operation. The cycle of operation may include a phase during which liquid may be removed from the laundry load, such as an extraction phase during which a drum holding the laundry load rotates at speeds high enough to impart a sufficient centrifugal force on the laundry load to remove the liquid. Ideally, the extraction phase continues until the residual moisture content (RMC) of the laundry load is sufficiently low for drying in a clothes dryer, which within the industry is generally 2%-4% by weight of the laundry load.

Both washers and dryers have costs related to their use, primarily energy costs, and water costs (in the case of washers). While attempts have been made to optimize the cost of extracting liquid and drying a laundry load to an acceptable level, these efforts have focused on the washer and dryer individually. Efficiencies of operation for each alone may not equal an optimal efficiency for the washer and drier as a pair.

SUMMARY OF THE INVENTION

According to one embodiment, a laundry treating appliance has a rotating drum defining a treating chamber in which a laundry load is received for treatment. A method of operating the appliance includes extracting moisture from the laundry load by rotating the drum to apply a centrifugal force to the laundry load; monitoring the remaining moisture content of the laundry load during the extracting of moisture; determining at least one of an amount of energy and cost of energy to extract additional moisture; and terminating the extracting of the moisture when the at least one of an amount of energy and cost of energy satisfies a threshold.

DESCRIPTION OF AN EMBODIMENT OF THE INVENTION

Figure 1:
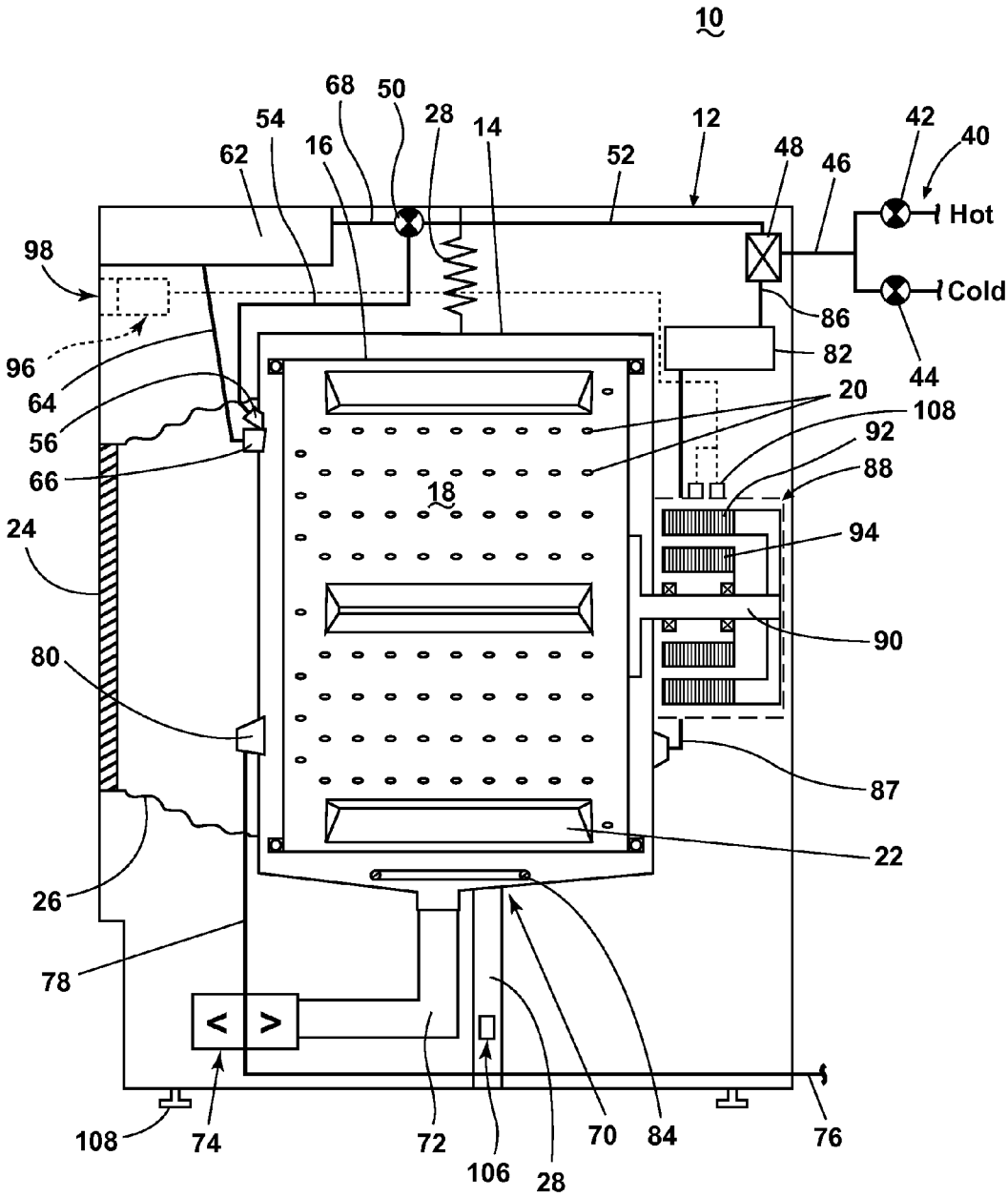
FIG. 1 is a schematic, cross-sectional view of a laundry treating appliance in the form of a horizontal axis washing machine according to one embodiment of the invention.

FIG. 1 is a schematic view of a laundry treating appliance according to a first embodiment of the invention. The laundry treating appliance may be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 supported within the cabinet 12 by a suitable suspension system and a drum 16 provided within the tub 14, the drum 16 defining at least a portion of a laundry treating chamber 18. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of the invention for the laundry holding system to comprise only a tub with the tub defining the laundry treating chamber.

The laundry holding system may further include a door 24 which may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62 which may be a single use dispenser, a bulk dispenser or a combination of a single and bulk dispenser. Non-limiting examples of suitable dispensers are disclosed in U.S. Pub. No. 2010/0000022 to Hendrickson et al., filed Jul. 1, 2008, entitled "Household Cleaning Appliance with a Dispensing System Operable Between a Single Use Dispensing System and a Bulk Dispensing System," U.S. Pub. No. 2010/0000024 to Hendrickson et al., filed Jul. 1, 2008, entitled "Apparatus and Method for Controlling Laundering Cycle by Sensing Wash Aid Concentration," U.S. Pub. No. 2010/0000573 to Hendrickson et al., filed Jul. 1, 2008, entitled "Apparatus and Method for Controlling Concentration of Wash Aid in Wash Liquid," U.S. Pub. No. 2010/0000581 to Doyle et al., filed Jul. 1, 2008, entitled "Water Flow Paths in a Household Cleaning Appliance with Single Use and Bulk Dispensing," U.S. Pub. No. 2010/0000264 to Luckman et al., filed Jul. 1, 2008, entitled "Method for Converting a Household Cleaning Appliance with a Non-Bulk Dispensing System to a Household Cleaning Appliance with a Bulk Dispensing System," U.S. Pub. No. 2010/0000586 to Hendrickson, filed Jun. 23, 2009, entitled "Household Cleaning Appliance with a Single Water Flow Path for Both Non-Bulk and Bulk Dispensing," and application Ser. No. 13/093,132, filed Apr. 25, 2011, entitled "Method and Apparatus for Dispensing Treating Chemistry in a Laundry Treating Appliance," which are herein incorporated by reference in full.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88, which may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotate the drum 16 at various speeds in either rotational direction.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to the invention. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
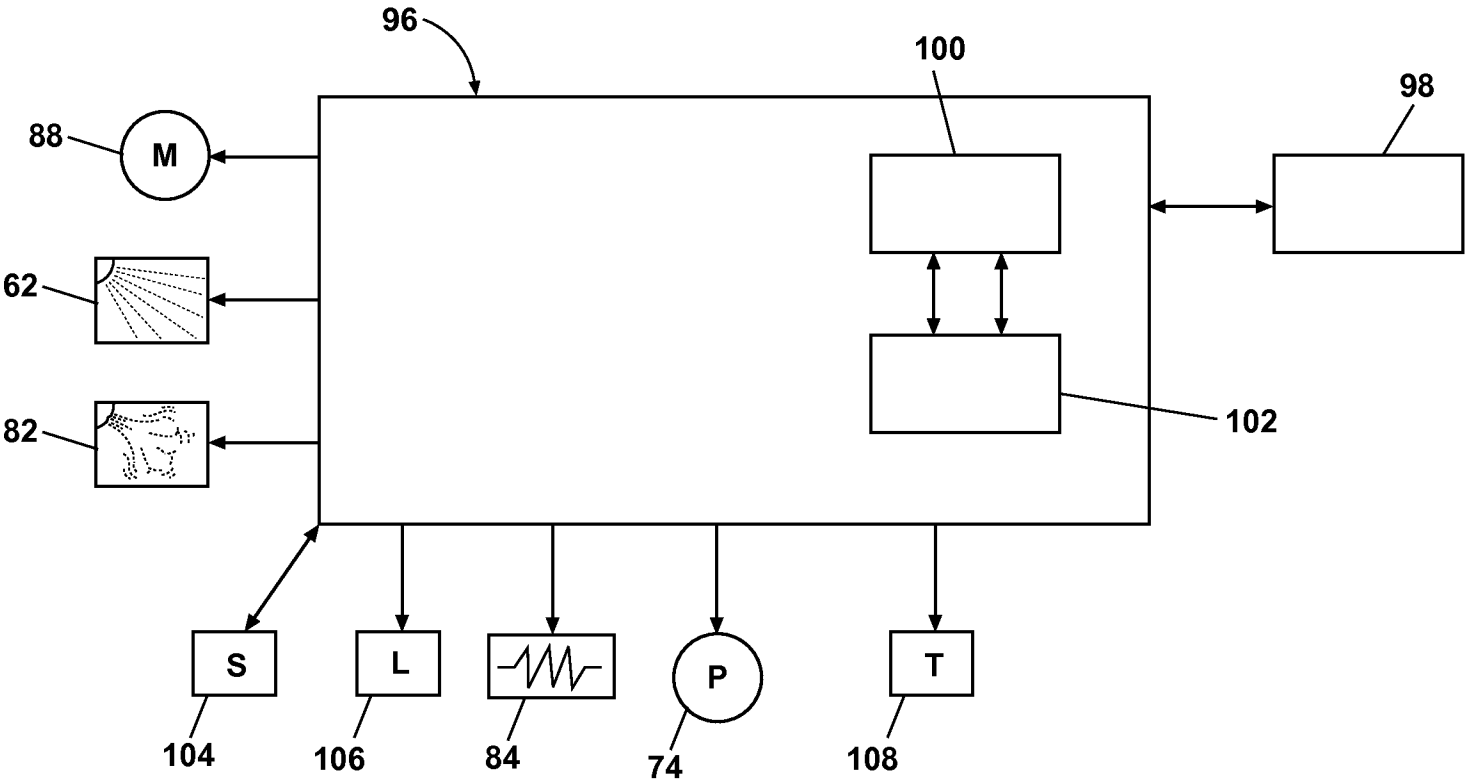
FIG. 2 is a schematic view of a controller of the laundry treating appliance of FIG. 1.

As illustrated in FIG. 2, the controller 96 may be provided with a memory 100 and a central processing unit (CPU) 102. The memory 100 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters, e.g. the mass of the laundry load, the inertia of at least one of the laundry load and the laundry load in combination with the drum 16, the torque of the motor 88 rotating the drum 16, the number of electrical closings of two spaced electrodes in the treating chamber 18, for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor and a motor torque sensor, which may be used to determine a variety of system and laundry characteristics, such as laundry load inertia or mass.

In one example, one or more load amount sensors 106 may also be included in the washing machine 10 and may be positioned in any suitable location for detecting the amount of laundry, either quantitative (inertia, mass, weight, etc.) or qualitative (small, medium, large, etc.) within the treating chamber 18. By way of non-limiting example, it is contemplated that the amount of laundry in the treating chamber may be determined based on the weight of the laundry and/or the volume of laundry in the treating chamber. Thus, the one or more load amount sensors 106 may output a signal indicative of either the weight of the laundry load in the treating chamber 18 or the volume of the laundry load in the treating chamber 18.

The one or more load amount sensors 106 may be any suitable type of sensor capable of measuring the weight or volume of laundry in the treating chamber 18. Non-limiting examples of load amount sensors 106 for measuring the weight of the laundry may include load volume, pressure, or force transducers which may include, for example, load cells and strain gauges. It has been contemplated that the one or more such sensors 106 may be operably coupled to the suspension system 28 to sense the weight borne by the suspension system 28. The weight borne by the suspension system 28 correlates to the weight of the laundry loaded into the treating chamber 18 such that the sensor 106 may indicate the weight of the laundry loaded in the treating chamber 18. In the case of a suitable sensor 106 for determining volume it is contemplated that an IR or optical based sensor may be used to determine the volume of laundry located in the treating chamber 18.

Alternatively, it has been contemplated that the washing machine 10 may have one or more pairs of feet 108 extending from the cabinet 12 and supporting the cabinet 12 on the floor and that a weight sensor (not shown) may be operably coupled to at least one of the feet 108 to sense the weight borne by that foot 108, which correlates to the weight of the laundry loaded into the treating chamber 18. In another example, the amount of laundry within the treating chamber 18 may be determined based on motor sensor output, such as output from a motor torque sensor. The motor torque is a function of the inertia of the rotating drum and laundry. There are many known methods for determining the load inertia, and thus the load mass, based on the motor torque. It will be understood that the details of the load amount sensors are not germane to the embodiments of the invention and that any suitable method and sensors may be used to determine the amount of laundry.

The previously described washing machine 10 may be used to implement one or more embodiments of the invention. The embodiments of the method of the invention may be used to control the operation of the washing machine 10 to control the speed of the motor 88 to control the movement of the laundry within the laundry treating chamber 18 to provide a desired mechanical cleaning action.

The controller 96 may also receive input from one or more sensors, which are known in the art. Non-limiting examples of sensors that may be communicably coupled with the controller 96 include: a treating chamber temperature sensor, a moisture sensor, a weight sensor, a drum position sensor, a motor speed sensor, a motor torque sensor 108, and the like.

The motor torque sensor 108 may include a motor controller or similar data output on the motor 88 that provides data communication with the motor 88 and outputs motor characteristic information such as oscillations, generally in the form of an analog or digital signal, to the controller 96 that is indicative of the applied torque. The controller 96 may use the motor characteristic information to determine the torque applied by the motor 88 using a computer program that may be stored in the controller memory 100. Specifically, the motor torque sensor 108 may be any suitable sensor, such as a voltage or current sensor, for outputting a current or voltage signal indicative of the current or voltage supplied to the motor 88 to determine the torque applied by the motor 88. Additionally, the motor torque sensor 108 may be a physical sensor or may be integrated with the motor 88 and combined with the capability of the controller 96, may function as a sensor. For example, motor characteristics, such as speed, current, voltage, direction, torque etc., may be processed such that the data provides information in the same manner as a separate physical sensor. In contemporary motors, the motors 88 often have their own controller that outputs data for such information.

When the drum 16 with the laundry load rotates during an extraction phase, the distributed mass of the laundry load about the interior of the drum is a part of the inertia of the rotating system of the drum and laundry load, along with other rotating components of the appliance. The inertia of the rotating components of the appliance without the laundry is generally known and can be easily tested for. Thus, the inertia of the laundry load can be determined by determining the total inertia of the combined load inertia and appliance inertia, and then subtracting the known appliance inertia. In many cases, as the total inertia is proportional to the load inertia, it is not necessary to distinguish between the appliance inertia and the load inertia.

The total inertia can be determined from the torque necessary to rotate the drum. Generally the motor torque for rotating the drum 16 with the laundry load may be represented in the following way:

$$\tau=J*\dot{\omega}+B*\omega+C \quad (1)$$

where, $\tau$=torque, J=inertia, $\dot{\omega}$=acceleration, $\omega$=rotational speed, B=viscous damping coefficient, and C=coulomb friction.

Historically, to determine the inertia, it was necessary to have a plateau followed by a ramp. During the plateau, the rotational speed would be maintained constant, and the resulting acceleration ($\dot{\omega}$) would be zero. Then, from equation (1), the torque would be expressed only in terms of B*$\omega$ in the following way:

$$\tau=B*\omega+C \quad (2)$$

C would be taken as zero since the Coulomb friction is typically very small compared to the remaining variables. Rearranging the variables, we have $$\tau/\omega=B.$$

$\tau$ and $\omega$ are variables that may be readily determined from torque sensors and velocity sensors, or directly from the motor. The B was readily calculated during a plateau.

Once B was known, it was possible to determine the inertia by accelerating the drum along a ramp. During such an acceleration, the inertia was the only unknown, and could be solved for. The acceleration was normally defined by the ramp, or was sensed. For example, most ramps are accomplished by providing an acceleration rate to the motor. This acceleration rate can be used for the acceleration in the equation.

One shortcoming of this approach is that B tends to be a function of speed and may increase as speed increases. The B calculated on the plateau was not the same value of B where the inertia was calculated. This error was generally minimal compared to the magnitude of the other numbers and could often be ignored. To minimize the error, the inertia could be calculated along the ramp as close as possible to the plateau.

Another, and for the current purposes, more important shortcoming is that the prior method required a plateau followed by a ramp to calculate the inertia, which made it practically impossible to calculate the inertia during the final extraction plateau because there was no subsequent ramp.

The following methodology provides for not only determining the inertia during any plateau, but doing so continuously, and doing so without the need for a ramp, either before or after the plateau. The methodology determines the inertia of the laundry load during a constant speed phase greater than the satellization speed. During the constant speed phase, periodic signals are applied to the constant speed profile. It has been observed that the inertia of the laundry load may be determined by applying a periodic torque signal to the constant speed profile to split the periodic signal into two ½ wave sections to solve for the inertia of the laundry load by cancelling out damping and friction forces.

Figure 3:
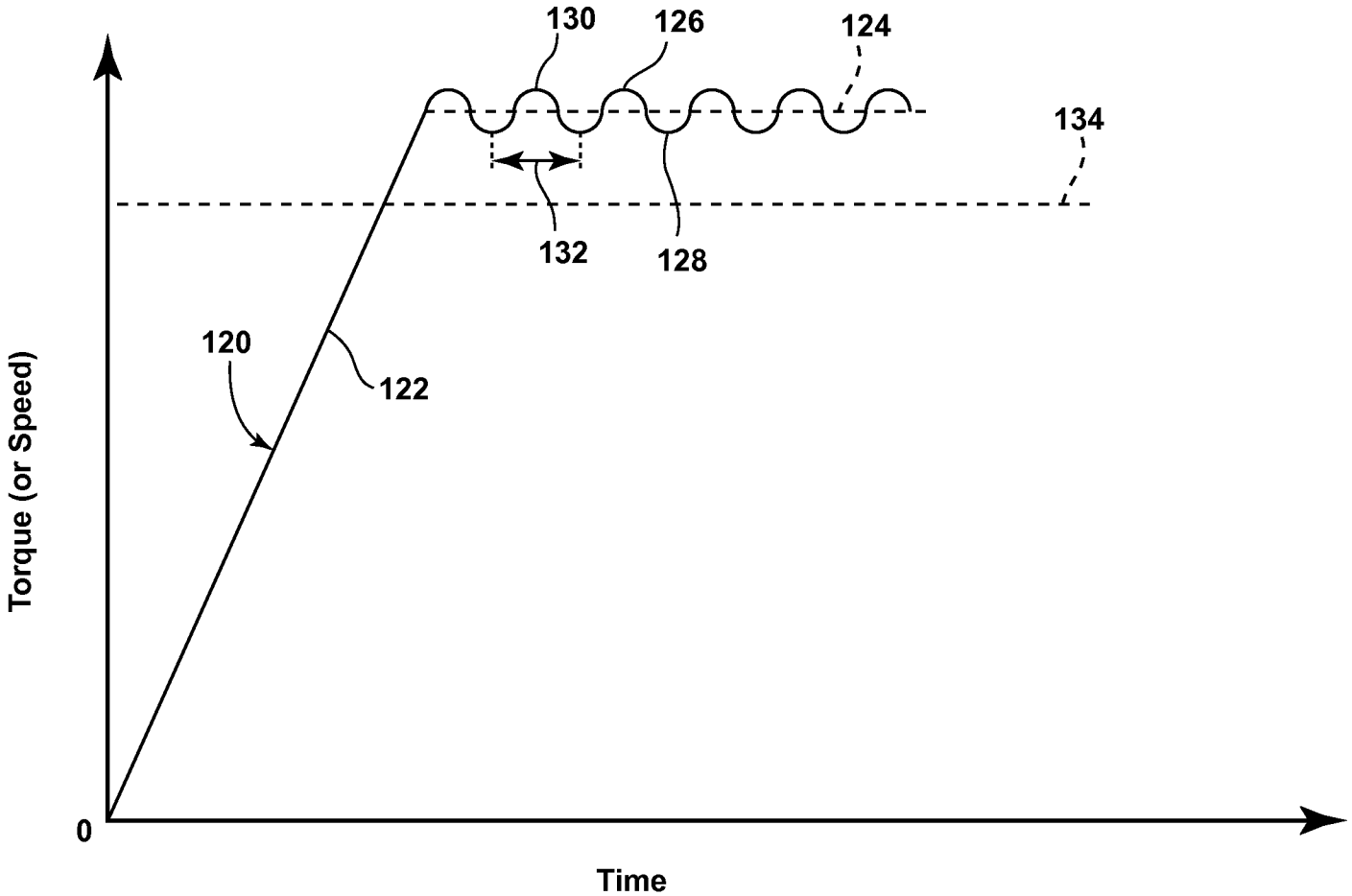
FIG. 3 is a graphical representation of a sinusoidal torque profile superimposed on the plateau portion of the profile of the drum during a constant speed phase, with the sinusoidal profile to repeatedly determine the inertia of the laundry load during the constant speed phase in the laundry treating appliance of FIG. 1.

FIG. 3 illustrates a plot of a periodic torque signal applied to the constant speed profile of the drum 16 during the constant speed phase. The speed profile 120 may be an extraction speed profile to remove the liquid from the laundry load in the treating chamber 18. The speed profile 120 may include an initial acceleration phase that may be linear, indicating a constant acceleration. The acceleration phase 122 may be configured to increase the rotational speed up to or exceeding a satellizing speed 134, at which most of the laundry sticks to the interior drum wall due to centrifugal force. As used herein, the term satellizing speed refers to any speed where at least some of the laundry load satellizes, not just the speed at which satellizing is first observed to occur.

The speed profile 120 may transition from the acceleration phase or ramp 122 to a constant speed phase or speed plateau 124 in excess of the satellizing speed 134. A periodic torque signal 126 may be superimposed on the speed plateau 124 to determine the inertia of the laundry load during the constant speed plateau 124. For example, the torque from the motor 88 may be configured to periodically increase and decrease by communicating with the motor torque sensor 108 and/or the controller 96. As a result, the resulting torque profile may be in the form of a periodic trace, such as the sinusoidal profile 126, or a saw tooth profile (not shown). The sinusoidal profile 126 may have a constant period 132, and may comprise a plurality of periods. The period 132 may be bisected at a maximum 130 or a minimum 128 into a half period representing a positive acceleration and a half period representing a negative acceleration. The positive acceleration half period may correspond to an increasing trace of the sinusoidal profile 126. The negative acceleration half period may correspond to a decreasing trace of the sinusoidal profile 126. The two half periods may be symmetrical with respect to the speed plateau 124.

The torque may be determined individually for the half periods. For example, utilizing the relationship expressed in equation (1), the torque for a first positive acceleration half period and a second negative acceleration half period may be determined in the following manner:

$$\tau_{first}=J*\dot{\omega}+B*\omega+C \quad (3)$$

$$\tau_{second}=J*(-\dot{\omega})+B*\omega+C \quad (4)$$

The difference between the torque of the motor 88 for a first half period and the torque of the motor 88 for the second half period may be represented in the following equation:

$$\tau_{first}-\tau_{second}=J*\omega+B*\omega+C-(J*(-\dot{\omega})+B*\omega+C)=2*J\dot{\omega} \quad (5)$$

Equation (5) may be solved for inertia, J, so that:

$$J=(\tau_{first}-\tau_{second})/2*\dot{\omega} \quad (6)$$

Both $\tau_{first}$ and $\tau_{second}$ may be determined by the motor torque output or sensor 108 and/or controller 96, and the acceleration $\dot{\omega}$ may be a known value, such as the acceleration provided by the controller 96 to the motor 88, or may be determined by a suitable sensor. Therefore, the equation (6) may be solved for the inertia after superimposing each single period 132 of the periodic signal 126 to the speed profile 120 during the constant speed plateau 124.

The inertia may also be updated after applying every single period 132 to the periodic signal 126. Alternatively, the inertia may be updated at a predetermined interval during a constant speed phase. For example, the inertia may be updated after completion of every two, three, or other multiple periods. The inertia may be updated by adjusting the frequency or amplitude of the periodic torque signal 126.

Figure 4:
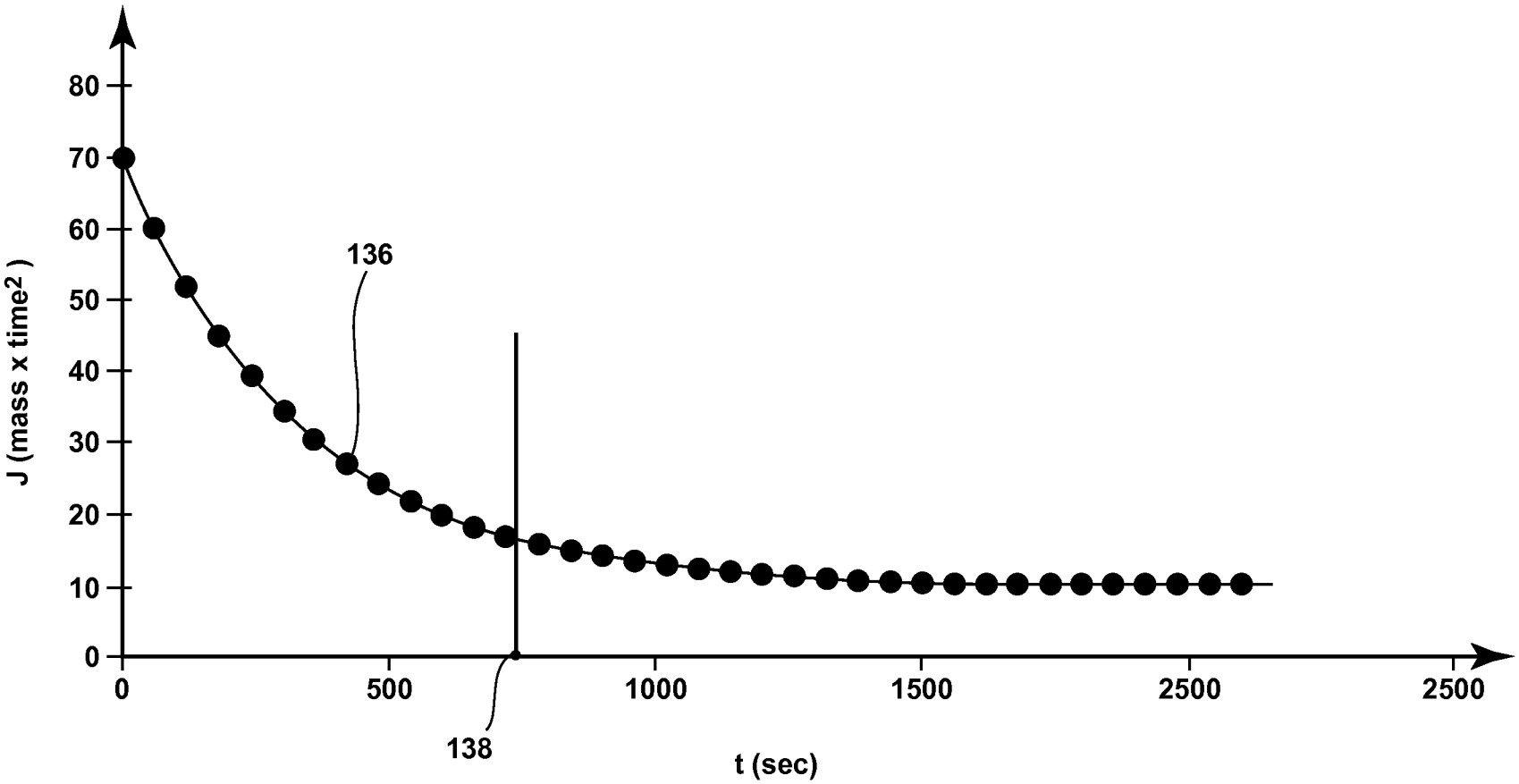
FIG. 4 is a graphical representation of inertia vs. time illustrating an asymptotic decrease in laundry load inertia as moisture is extracted during a high-speed spin cycle.

As the extraction progresses, the inertia may decrease in an asymptotic manner, as illustrated in FIG. 4. This asymptotic decay in inertia 136 may be continuously monitored by utilizing the methodology described above until the inertia reaches a reference value 138 representing an optimal extraction time and residual moisture content. The ability to monitor the RMC of the laundry load, along with the value of the dry mass of the laundry load in the drum, may enable a decision to be made regarding whether it is most efficient to continue extracting liquid in the washer or some other manner. The efficiency may be defined in terms of either or both of the cost to extract additional liquid or the amount of energy consumed to extract additional liquid.

The high-speed portion of the spin cycle, illustrated in FIG. 3 as the speed plateau 124, may be used to compute a high-speed inertia calculation. This inertia calculation may be repeated and updated during the duration of the high-speed spin; for example, the inertia calculation may be updated approximately once every 10 seconds, although greater or lesser time intervals may be utilized.

One application for the high-speed inertia calculation may be to determine an optimal cycle time, i.e. when to terminate the cycle. This may help to prevent continuing to spin after an optimal RMC has been achieved. Another application may be to calculate the numerical value of the RMC in the laundry load.

Referring again to FIG. 4, as the load spins at a high speed, liquid may be extracted from the clothes. Initially, when the moisture content is high, the rate of liquid extraction may be large. As a result of this large liquid extraction, the inertia may drop substantially. However, as time passes at a high spin speed, less liquid may be extracted over a given period of time. As a result, the change in inertia may tend toward the reference value 138. Therefore, by monitoring the change in calculated inertia, the optimal time to stop spinning may be identified.

The optimal end of cycle time may be determined when the derivative of the inertia calculation tends to zero. Determining the optimal "time-to-stop-cycle" value may avoid, or reduce the likelihood of, terminating the spin phase too early, leaving a wet load. It may also eliminate spinning too long and expending electrical energy without adding any value to the machine performance, i.e. the laundry load isn't getting any drier.

The wet mass value of the laundry load may be inferred from the high-speed inertia estimation discussed above. The initial dry mass of the laundry load may be determined immediately after the load is placed in the drum 16, before any liquid or other substance has been introduced. There are many well-known methods to determine the dry load, such as algorithms, weight sensors, user inputs, and inertia methods, and they will not be discussed here. From the dry mass, the RMC at the end of the cycle may be determined. Once a determination is made that the inertia is not appreciably changing over time and, thus, the cycle is complete, the wet and dry mass values of the laundry load may be used to determine how much liquid is left in the load. Thus:

$$\text{Mass}_{remaining\ liquid} = \text{liquid still in laundry load}$$

$$\text{Mass}_{wet} = \text{liquid} + \text{laundry load}$$

$$\text{Mass}_{dry} = \text{laundry load}$$

$$\text{Mass}_{remaining\ liquid} = \text{Mass}_{wet} - \text{Mass}_{dry} \xrightarrow{\text{yields}} \text{RMC calculation}$$

This may be conveyed to a user, such as through the user interface 98, as a numerical value indicating to the user the degree of dryness the load has at the end of the wash cycle.

As discussed above, the inertia calculation may be repeated and updated during the high-speed spin; that is, the inertia calculation may be repeatedly updated after a series of preselected periodic time intervals. Examples of such time intervals are illustrated as the individual points along the curve 136. Knowing the wet and dry mass values of the laundry load, each updated value of inertia may be correlated to a RMC value. The "current" RMC may be compared to a preselected target RMC correlating to the end of the cycle. The difference between the 2 values is the liquid yet to be extracted.

Alternatively, the calculated "current" inertia value may be compared to the inertia value determined for the dry laundry load, i.e. a "dry" inertia value. The approach of the "current" inertia value to the "dry" inertia value may correlate to the laundry load RMC approaching the RMC of the "dry" laundry load. This may be utilized to determine an end-of-cycle point, thereby operating the clothes washer only so long as necessary, and consequently optimizing energy costs for the washer.

While an efficiency decision may be made for the clothes washer alone without any knowledge of the type of appliance that will remove the RMC, by assuming the characteristics of the drying appliance, or establishing a typical reference for the drying appliance, so that the efficiency of the drying appliance is established, an optimal efficiency decision may be made for the combination of washer and dryer.

Figure 5:
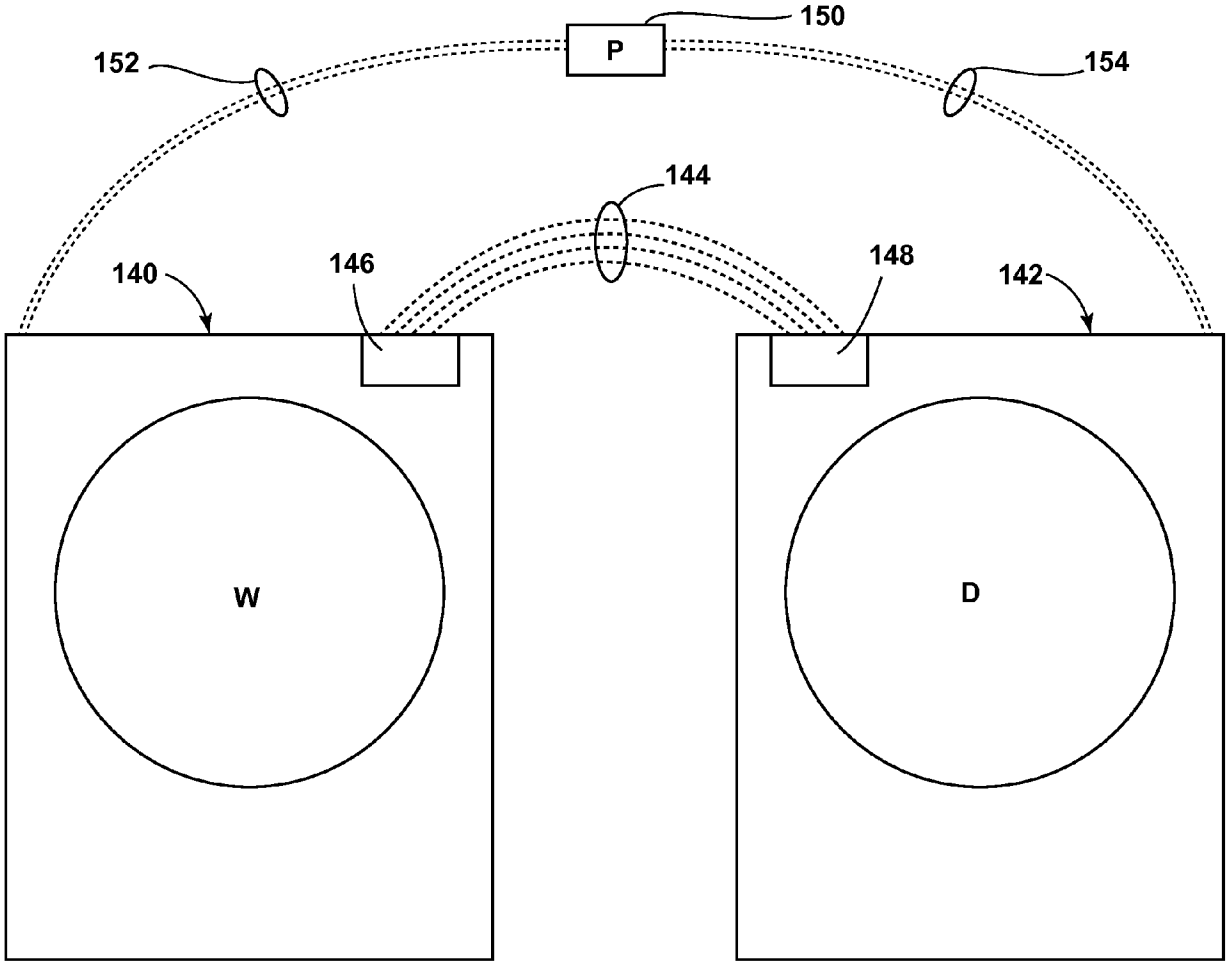
FIG. 5 is a schematic view of a clothes washer and clothes dryer operably coupled to exchange cost and efficiency data, and operably coupled to an external power cost source, for optimizing the energy usage of the pair.

The above evaluative methodology may be used with connected appliances. Referring to FIG. 5, if a washer 140 and a dryer 142 can communicate, such as through a bus 144 coupling a washer controller 146 with a dryer controller 148 or a wireless connection, information developed by the clothes washer 140 related to RMC may be used to optimize the dryer cycle, or the washer and dryer cycles together, further optimizing the utilization of energy. For example, a "matrix" of costs per unit of energy utilized may be stored in the washer controller 146 along with a unit of energy required for the washer 140 to extract a predetermined volume of liquid, which may be an efficiency reference established for a particular washer, and a similar matrix may be stored in the dryer controller 148 along with a unit of energy required for the dryer 142 to remove a predetermined volume of liquid, which also may be an established efficiency reference. The predetermined volumes of liquid for the washer 140 and the dryer 142 may be a percentage of the moisture by weight of the laundry load. Alternatively, algorithms may be utilized to determine the cost and/or amount of energy required to extract and remove a unit of liquid as the extraction and drying progress. These values may be characterized as "efficiency" rates per unit of liquid.

The "efficiency" rate may be compared to a threshold value, which may be independent of any particular machine, such as an industry standard. Alternatively, the threshold value may be a government standard, such as a Federal EPA efficiency standard. The efficiency rates of a paired washing appliance and drying appliance may be established. When the efficiency rate of the washing appliance equals or exceeds that of the drying appliance, the wash cycle may be terminated, and the dryer cycle may be initiated.

Optimizing performance for the paired washer 140 and dryer 142 essentially means optimizing for cost, and optimizing for energy. Optimizing cost is related to cost effectiveness in removing remaining liquid. Optimizing energy is related to the amount of energy utilized, i.e. which appliance uses less energy to remove remaining liquid. Lower usage may not always be the lesser in cost. The dryer may often be gas, and the washer is often electricity. Each may have a different cost per BTU.

The energy, e.g. electricity or gas, required to run the dryer 142 for a known load mass and RMC, may be optimized so that the wash cycle is ended when the total system energy at the end of the dryer cycle is a minimum value. The washer methodology discussed above may determine the appropriate point at which to end the wash cycle based on the cost function of the laundry pair becoming a minimum. This determination may be based on variables, such as the laundry load mass, the RMC of the laundry load, the total quantity and cost of energy the washer 140 and dryer 142 use for a load mass and RMC, the cost of extracting liquid from the load to be dried, variations in the extraction time and drying time with incremental changes in one or the other, and the like. Cost and performance data may be stored in the controllers 146, 148 to be utilized in the optimization routine, and exchanged between the washer 140 and dryer 142 through the bus 144. The washer 140 and dryer 142 may also be coupled with a power supply or power rate source 150 through communication lines 152, 154, so that cost and performance data may be periodically updated to reflect changes in energy costs. These updates may be periodic or continuous, and may be utilized to continuously adjust the end-of-cycle point, thereby optimizing the cost and energy consumption for the washer/dryer pair. Other factors relating to efficiency and cost may be taken into account, such as changes in performance as the washer and dryer age, maintenance history, and the like.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of controlling an operation of a laundry treating appliance having a rotating drum defining a treating chamber in which a wet laundry load is present, the method comprising:

extracting a portion of moisture present in the laundry load from the laundry load by rotating the drum to apply a centrifugal force to the laundry load;

monitoring a value representative of a remaining amount of the moisture present in the laundry load during the extracting;

determining, based on the value, at least one of an amount of energy, or a cost of energy to extract a portion of the remaining amount of the moisture present in the laundry load during the extracting; and terminating the extracting when the at least one of the amount of energy satisfies a first threshold, or the cost of energy satisfies a second threshold.

2. The method of claim 1 wherein the rotating of the drum comprises rotating the drum at a speed wherein at least a portion of the laundry load is satellized within the treating chamber.

3. The method of claim 1 wherein the monitoring of the representative value comprises monitoring an operating parameter that is indicative of a mass of the laundry load.

4. The method of claim 3 wherein the operating parameter comprises an inertia of at least one of the laundry load or the laundry load in combination with the drum.

5. The method of claim 3 wherein the operating parameter comprises a torque of a motor rotating the drum.

6. The method of claim 3 wherein the operating parameter comprises a number of electrical closings of two spaced electrodes in the treating chamber.

7. The method of claim 1 wherein the first threshold represents an amount of energy to remove the remaining amount of moisture by drying, and the second threshold represents a cost of energy to remove the remaining amount of moisture by drying.

8. The method of claim 7 wherein the first and second thresholds are determined by a controller controlling the operation of the laundry treating appliance.

9. The method of claim 8 wherein the controller at least one of calculates or looks up the first and second thresholds.

10. The method of claim 9 wherein the first and second thresholds are determined by a laundry drying appliance in communication with the laundry treating appliance.

11. The method of claim 1 wherein the portion of the remaining amount of moisture comprises a predetermined amount of the remaining amount of moisture.

12. The method of claim 11 wherein the predetermined amount of the remaining amount of moisture is a percentage of the remaining amount of moisture by weight of the laundry load.

13. The method of claim 1 wherein the first and second thresholds are determined by a laundry drying appliance in communication with the laundry treating appliance.

* * * * *